US005493740A

United States Patent [19]

De Lorenzo

[11] Patent Number: 5,493,740

[45] Date of Patent: Feb. 27, 1996

[54] SOFA-BED HAVING AN ARTICULATED FOLDING STRUCTURE

[75] Inventor: Stelio De Lorenzo, Seregno, Italy

[73] Assignee: Lampolet, S.p.A., Milan, Italy

[21] Appl. No.: 322,094

[22] Filed: Oct. 12, 1994

[51] Int. Cl.[6] ..... A47C 17/02

[52] U.S. Cl. ..... 5/14; 5/28

[58] Field of Search ..... 5/14, 28, 29, 35, 5/36

[56] References Cited

U.S. PATENT DOCUMENTS

| | | | |
|---|---|---|---|
| 1,012,861 | 12/1911 | Karpen | 5/14 |
| 1,401,796 | 12/1921 | Konrad | 5/14 |
| 1,543,103 | 6/1925 | Heale . | |
| 1,686,384 | 10/1928 | Camb | 5/14 |
| 2,485,219 | 10/1949 | Shumsky | 5/14 |
| 2,664,145 | 12/1953 | Creveling et al. | 5/35 |

FOREIGN PATENT DOCUMENTS

| | | |
|---|---|---|
| 2581524 | 5/1985 | France . |
| 429533 | 5/1935 | United Kingdom . |

*Primary Examiner*—Michael J. Milano
*Attorney, Agent, or Firm*—Laff, Whitesel, Conte & Saret, Ltd.

[57] ABSTRACT

A sofa-bed having an articulated folding structure comprises a fixed carrying framework (2) to which a main movable frame (3) is engaged through a pantograph linkage (4), which main frame is movable in a vertical direction. Consecutively and rotatably connected to the main movable frame (3) are first and second auxiliary movable frames (17, 18). An interconnecting lever (20) operating between the main movable frame (3) and the second auxiliary movable frame (18) interconnects the rotational movements of the movable frames (17, 18). A synchronization lever (21) operatively connects the pantograph linkage (4) to the auxiliary movable frames (17, 18) for the purpose of timing the upward and downward displacement of the main movable frame (3) with the rotations of the auxiliary movable frames (17, 18).

11 Claims, 6 Drawing Sheets

SOFA-BED HAVING AN ARTICULATED FOLDING STRUCTURE

FIELD AND BACKGROUND OF THE INVENTION

The present invention relates to a sofa-bed with an articulated folding structure of the type defined in the preamble of claim 1.

It is known that sofa-beds with an articulated folding structure essentially comprise a fixed carrying framework to which three or more movable frames disposed consecutively and pivotally engaged with each other are linked. The movable frames are shiftable from a closed position in which they are folded over upon each other and housed within the fixed carrying framework thereby defining the conformation of a sofa-bed, to an open or unfolded position in which they are extended with respect to each other, thereby defining the conformation of a bed.

In this type of sofa-beds, the sofa back is generally fastened to the fixed carrying framework. This involves an important reduction in the space that the movable frames can use for entering the fixed carrying framework and coming out of same, during the closing and opening steps respectively of the sofa-bed. For the above reason, each of the movable frames is formed with a longitudinal extension greatly lower than that of the fixed carrying framework within which it is housed in the closed position. In addition, on passing from the closed position to the open position, the movable frames must carry out a starting movement involving a rotation and a translation with respect to the fixed carrying framework so as to reach a raised and advanced position relative to said carrying framework.

It is apparent from the above that in order to obtain a sufficiently wide bed, it is often necessary to use many movable frames folded over upon each other, as well as very complicated kinematic driving mechanisms. On the other hand, it will be also recognized that due to the presence of many movable frames, the thickness of a mattress disposed between said frames is to be greatly reduced, which brings about clear inconveniences from the point of view of the comfort offered by the mattress itself. It is also to be noted that the bulkiness of the sofa-bed when opened is caused not only by the bed framework, but also, although this is not actually necessary, by the sofa back which is rigidly associated with the fixed carrying framework, as above said.

In order to obviate the above drawbacks, the same applicant has recently developed a sofa-bed with an articulated folding structure in which the back structure is associated with one of the movable frames and not with the fixed carrying framework.

In addition, in order to enable the use of movable frames having sizes substantially identical to those of the fixed carrying framework, such movable frames have been connected to a pantograph linkage associated with the fixed carrying framework. Thanks to the above mechanism, the movable frames, before taking an extended configuration with respect to each other, carry out a starting vertical translational motion bringing them from the closed position to an intermediate position in which the movable frames, still folded over upon each other, are disposed above the fixed carrying framework. Under this situation, two movable frames of a longitudinal extension substantially equal to that of the fixed carrying framework could be used, thereby reducing the number of the necessary movable frames with respect to the known art, the bed sizes being unchanged.

Notwithstanding the clear advantages achieved, the above described sofa-bed still has problems and drawbacks from the operating point of view when passing from the closed position to the open position and vice versa. In fact, for opening the sofa-bed it is first of all necessary to lift the movable folded frames as far as an intermediate position above the fixed carrying framework is reached and, only afterwards, to cause their rotation with respect to each other until the unfolded position is achieved, in that the vertical translational motion of the movable frames is independent of the rotatory alignment movement of the same. In addition, once the set of movable frames has been raised, the use of a retaining device is necessary for ensuring the vertical locking of the set in the intermediate raised position in order to prevent the pantograph linkage from closing upon itself by effect of its weight. Finally, referring particularly to the closed position, it is to be pointed out that the steadiness in such a condition exclusively relies on a second retaining device, which brings about further construction complications. Due to the last mentioned reason the use of a mattress of high elastic stiffness is practically impossible, because such a mattress will tend to spontaneously extend and therefore will not be able to ensure a stable set up to the sofa.

SUMMARY OF THE INVENTION

Under this situation, the main object of the present invention is to substantially obviate all the above described drawbacks.

In particular, it is an object of the invention to provide a sofa-bed having an articulated folding structure in which the vertical translational motion of the movable frames and the rotatory extension movement of the same frames are synchronized, so that by a single operation it is possible to pass from the closed position to the open position and vice versa.

Another object of the invention is to provide a sofa-bed which is very steady both in the open position and in the closed position although no retaining devices are required.

The foregoing and further objects that will become more apparent in the course of the following description are substantially attained by a sofa-bed having an articulated folding structure as defined in the characterizing part of claim 1.

BRIEF DESCRIPTION OF THE DRAWINGS

Further features and advantages will be best understood from the description of a sofa-bed in accordance with the present invention taken hereinafter by way of non-limiting example with reference to the accompanying drawings, in which.

DESCRIPTION OF THE PREFERRED EMBODIMENTS

Figure 1:
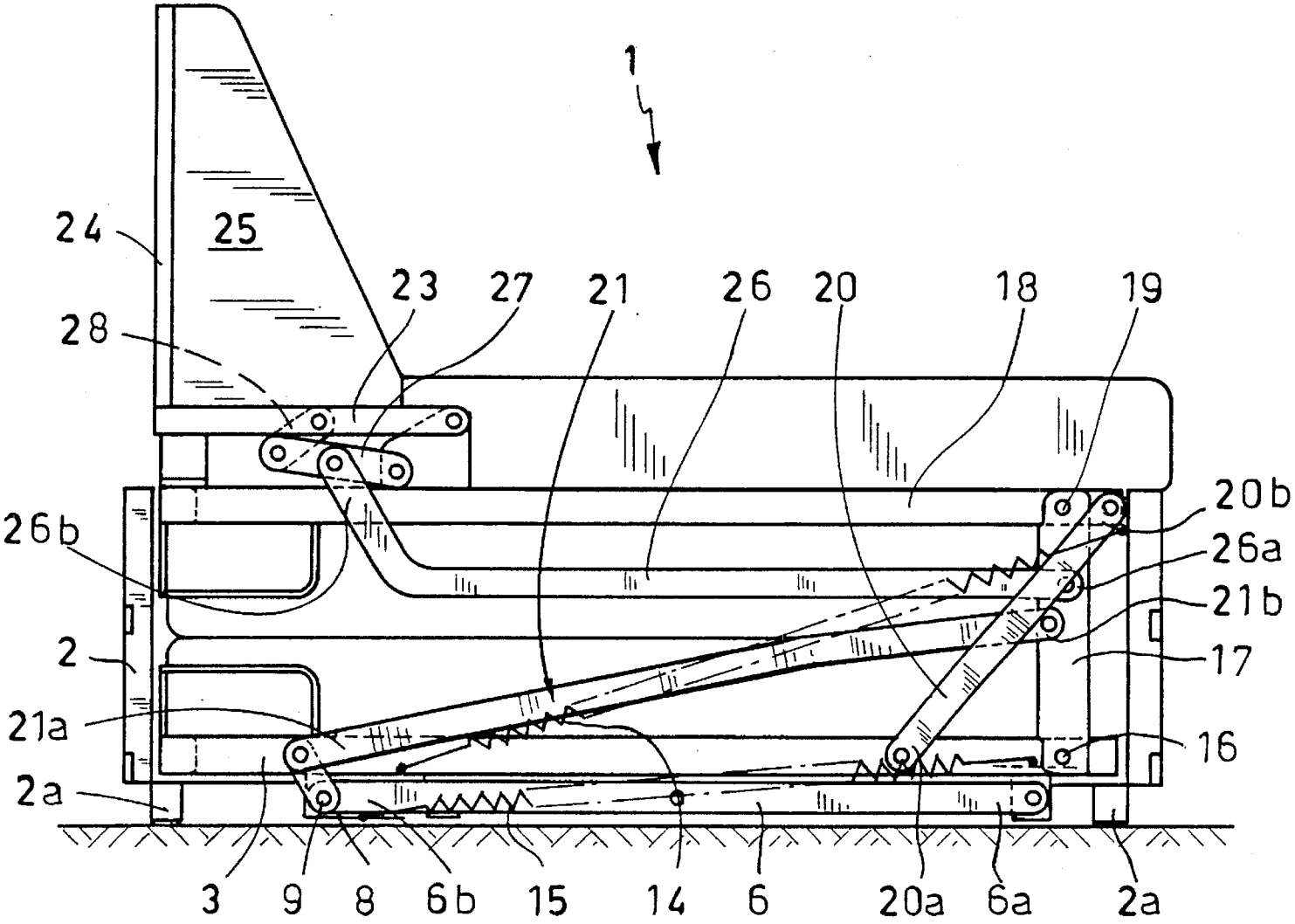
FIG. 1 is a side view of one embodiment of the sofa-bed in reference in the closed position.

Referring to the drawings, a sofa-bed having an articulated folding structure in accordance with the invention has been generally identified by reference numeral 1.

The sofa-bed 1 is comprised of a fixed carrying framework 2, resting on the ground by means of support feet 2*a*, to which side support arms not shown in the drawings may be fixedly engaged. Linked to the fixed carrying framework 2 is a main movable frame 3, by means of a pantograph linkage 4 operatively interposed between the fixed carrying framework 2 and the main movable frame 3. Practically, the main movable frame 3 and pantograph linkage 4 define a lifting unit 5, by virtue of which the main movable frame can be moved in a substantially vertical direction from a position in which it is housed in the bottom of the fixed carrying framework 2 to an operating raised position with respect to the fixed framework. The pantograph linkage 4 comprises a first and a second lifting rod 6 and 7 centrally hinged on each other at a commun fulcrum. The first lifting rod 6 has one end 6*a* hinged on the fixed carrying framework 2 and a second end 6*b* slidably and rotatably linked to one horizontal guide element 8 integral with the main movable frame 3. More particularly, the second end 6*b* of the first lifting rod 6 fixedly carries one pin 9 extending perpendicular to the first lifting rod itself. Rotatably engaged to the pin 9 is one roller 10 slidable in said first horizontal guide element 8. In turn, the second lifting rod 7 has one end 7*a* slidably and rotatably linked to a second horizontal guide element 11 fixedly carried by the fixed carrying framework 2 by means of a second roller 12. Said second roller 12, like the first roller 10, is rotatably engaged to a second pin 13, rigidly carried by the first end 7*a* of the second lifting rod 7, at right angles thereto. The second lifting rod 7 is then hinged, at its second end 7*b*, on the main movable frame 3.

As viewed from the accompanying drawings, the lifting rods 6 and 7 preferably have the same length and during the vertical upward movement of the main movable frame 3 they pass from a starting condition in which they are substantially parallel to each other to a final condition in which they are mutually crossed, thereby causing the opening of the pantograph linkage 4 and raising of the movable frame 3. In addition, it is to be noted that the raising step of the main movable frame 3 is advantageously assisted by the presence of a first and a second helical spring 14 and 15 operatively fitted between the pantograph linkage 4 and the fixed carrying framework 2. In greater detail, the first helical spring 14 has one end 14*a* fastened to the fixed carrying framework 2 and a second end 14*b* secured to the first lifting rod 6. Likewise, the second helical spring 15 has one end 15*a* fastened to the fixed carrying framework 2 and a second end 15*b* rigidly engaged with the second lifting rod 7. Practically, with reference to the accompanying drawings, the helical springs 14 and 15 draw the respective ends 6*b* and 7*a* of the lifting rods 6 and 7 to the right, thereby causing the pantograph linkage 4 to open and the main movable frame 3 to rise.

One auxiliary movable frame 17 is also rotatably and consecutively engaged to said main movable frame, at one pivot axis 16 thereof. In turn, a second auxiliary movable frame 18 rotating about a second pivot axis 19 is consecutively engaged to the first movable auxiliary frame 17.

Practically, the three movable frames 3, 17 and 18 can be rotated with respect to each other about said first and second pivot axes 16 and 17 so that they pass from a condition in which they are folded over upon each other to a condition in which they are extended or unfolded and define the structure of a bed.

As shown in the accompanying drawings, in order to enable the simultaneous rotation of the auxiliary movable frames 17 and 18 with respect to the main movable frame 3, an interconnecting lever 20 is provided which operates between the main movable frame and the second auxiliary movable frame 18. The first and second auxiliary movable frames 17 and 18 together with the interconnecting lever 20 define an overturning unit 30 arranged to enable the rotation of the auxiliary movable frames from the position in which they are folded over on the main movable frame 3 to the position in which they are consecutively aligned relative to each other and the main movable frame 3.

In accordance with the present invention, also provided in an original manner is a synchronization lever 21 arranged to synchronize the vertical raising and lowering movement of the main movable frame 3 with the rotations of the auxiliary movable frames 17, 18, so as to enable the sofa-bed 1 to be opened and closed by a single operation. As shown in the drawings, the synchronization lever 21 has one end 21*a* engaged to the pantograph linkage 4, for example at a hooking tab 22 extending from the second end 6*b* of the first lifting rod 6, and a second end 21*b* connected to the overturning unit 30.

Figure 2:
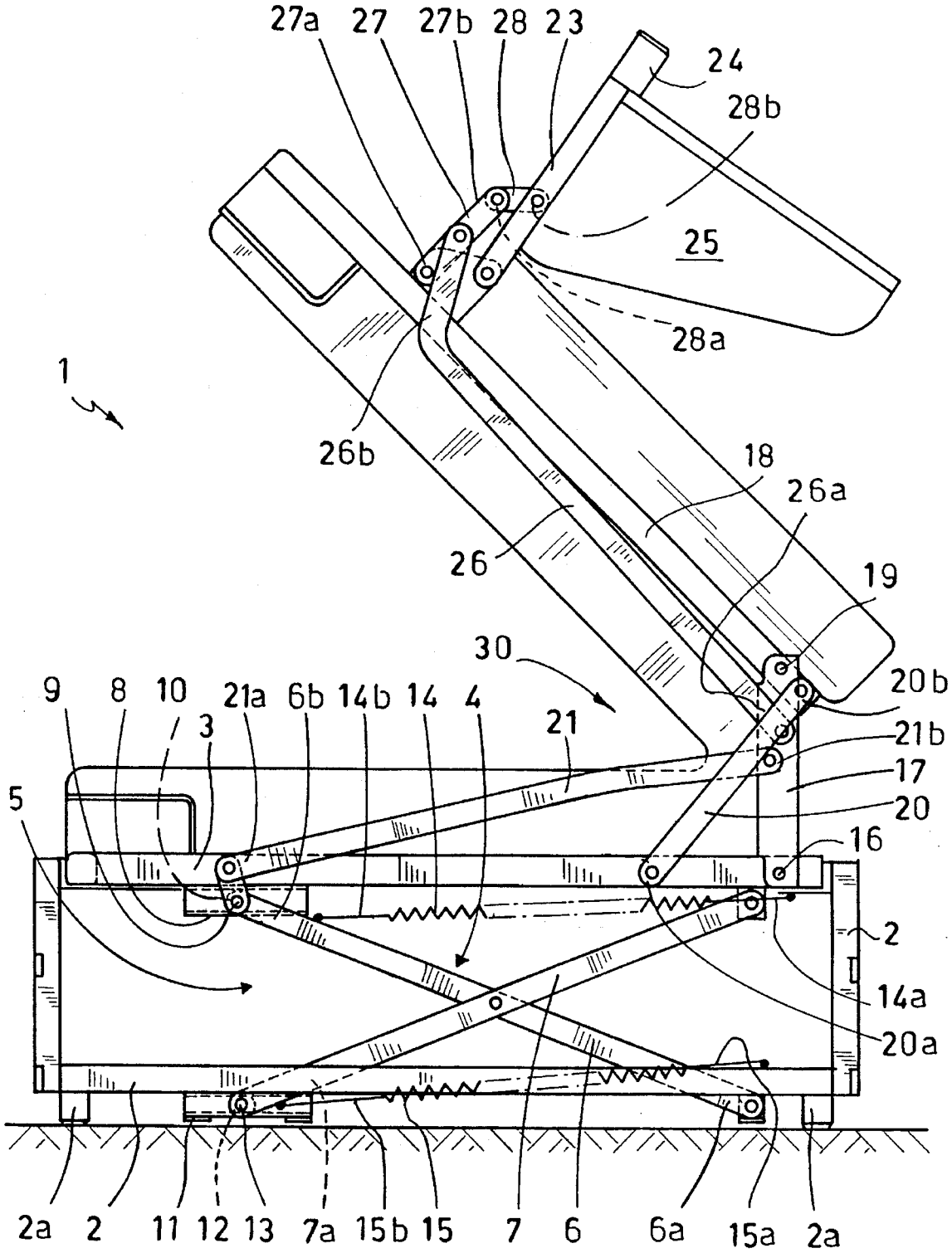
FIG. 2 is a side view of the sofa-bed shown in FIG. 1 in an intermediate position.
Figure 3:
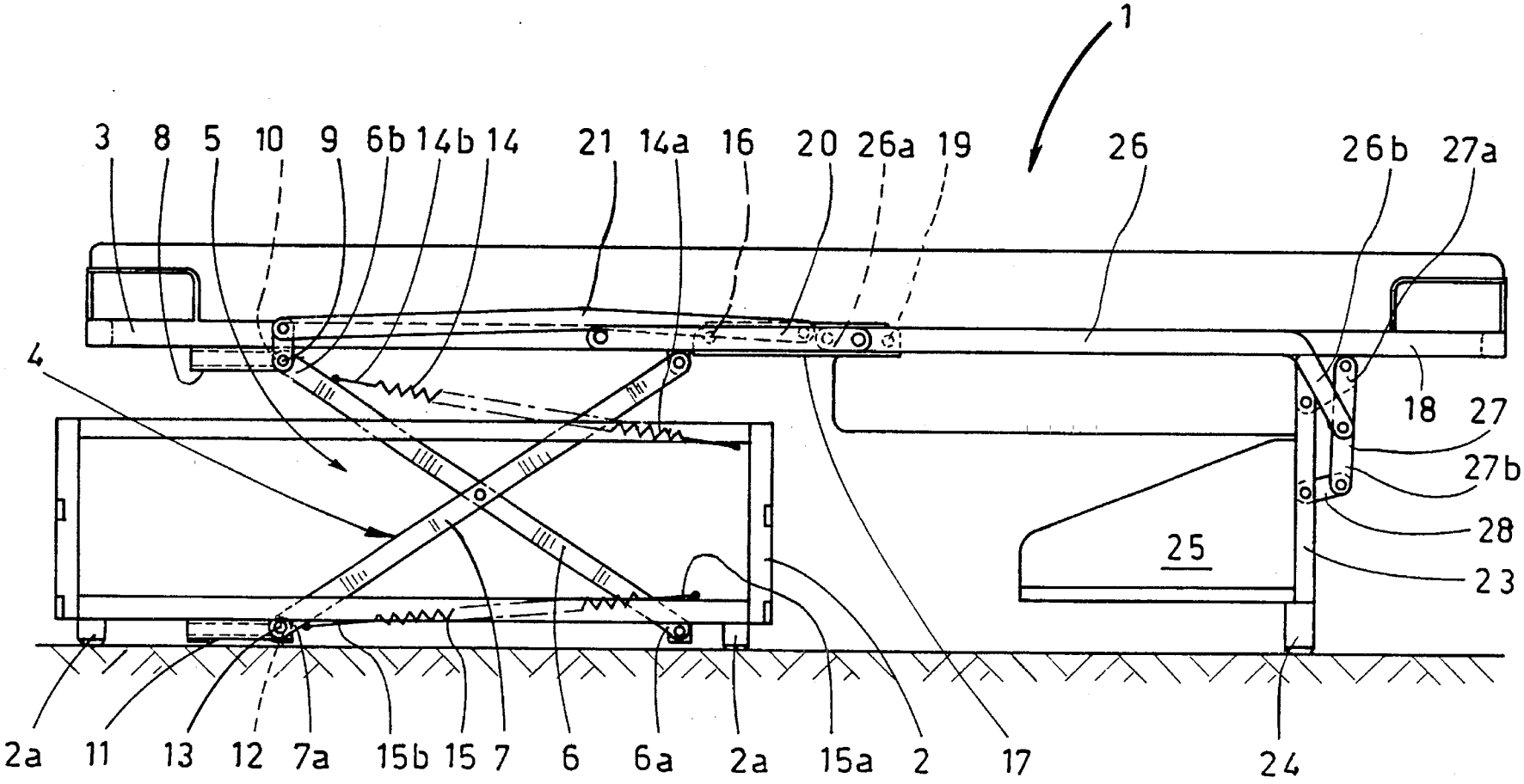
FIG. 3 is a side view of the sofa-bed of FIG. 1 in an open position.

In greater detail, as shown in FIGS. 1, 2 and 3 relating to one embodiment of the inventive sofa-bed, the second end 21*b* of the synchronization lever 21 is hinged on the auxiliary movable frame 17, at a central portion thereof for example. In this case, the interconnecting lever 20 has one end 20*a* hinged on the main movable frame 3, preferably at an intermediate area between the first pivot axis 16 and the first end 21*a* of the synchronization lever 21, and a second end 20*b* hinged on the second auxiliary movable frame 18, at an end portion 18*a* thereof extending beyond the second pivot axis 19.

Practically, the synchronization lever 21 transmits the horizontal displacements of the second end 6*b* of the first lifting rod 6 to the first auxiliary movable frame 17 thereby causing, through lifting of the main movable frame 3, a clockwise rotation of said first auxiliary movable frame 17 about the first pivot axis 16. Simultaneously, the interconnecting lever 20 acts in such a manner that, as a result of the rotation of the first auxiliary movable frame 17, the simultaneous rotation of the second auxiliary frame 18 in the same direction occurs.

Figure 4:
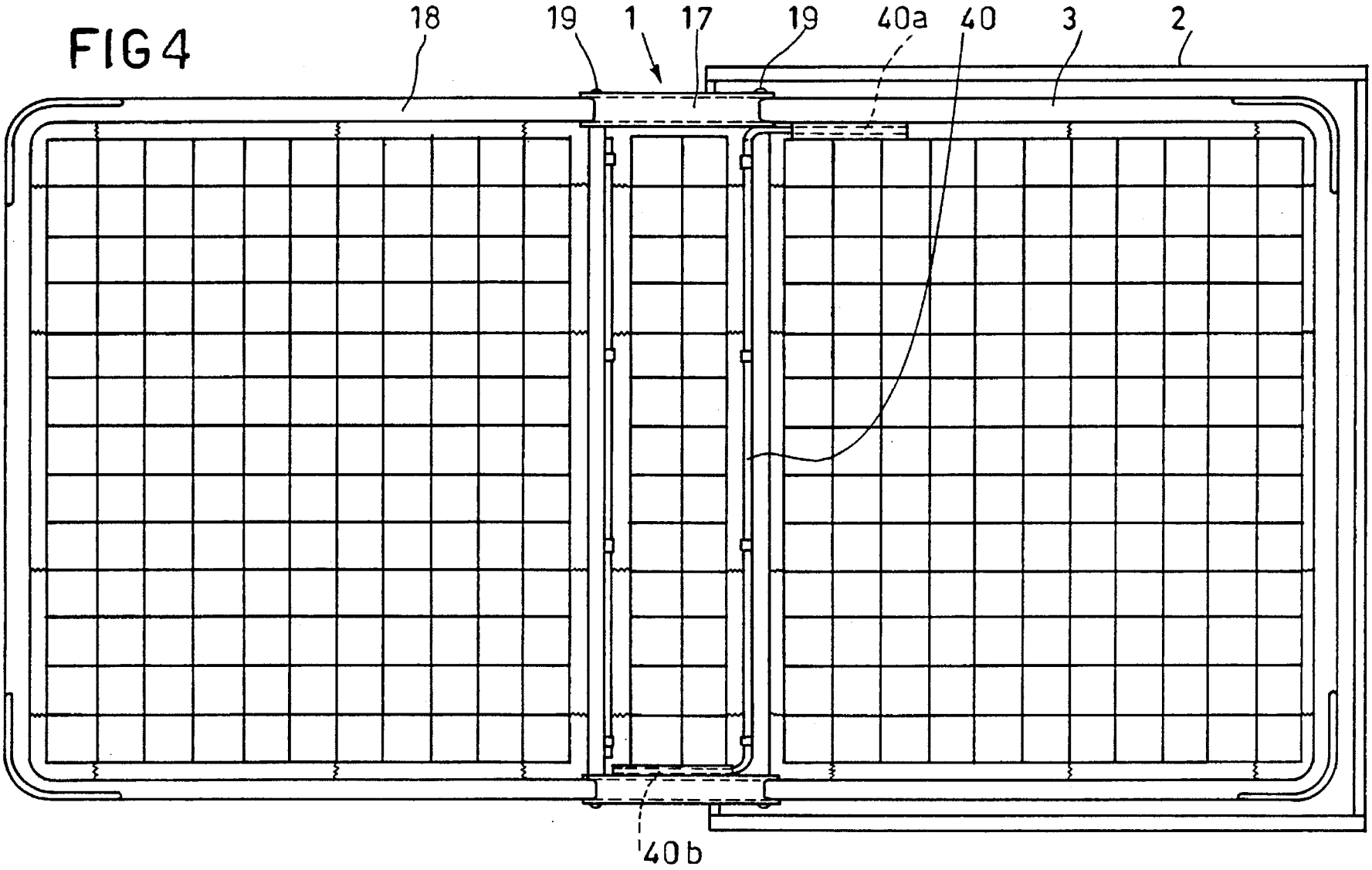
FIG. 4 is a top view of the sofa-bed in the open position.

Advantageously, a torsion bar 40 (FIG. 4) is also provided which substantially extends in a direction parallel to the first and second pivot axes 16 and 19 and has one end 40*a* fastened to the main movable frame 3 and a second end 40*b* fastened to the first auxiliary movable frame 17. The torsion bar 40 is such arranged that it stores an elastic energy during the sofa-bed opening step and gives back said stored elastic energy during the sofa-bed closing step, thereby greatly facilitating the user's task.

Turning back to FIGS. 1, 2 and 3, a movable support frame 23 is also engaged to the second auxiliary movable frame, and auxiliary support feet 24 as well as a sofa back 25 are associated with said support frame 23. The movable support frame 23 which is articulated at its end on the second auxiliary movable frame 18, is operatively connected to the first auxiliary movable frame 17 and therefore the main movable frame 3, so that the rotation of said movable support frame 23 gives rise, as a result, to the rotation of the auxiliary movable frames 17 and 18 as well as the raising of the main movable frame 3. In fact, provision is made for an intermediate lever 26 having one end 26*a* pivotally mounted to the first auxiliary movable frame 17, close to the second end 21 of the synchronization lever 21 for example, and the opposite end 26*b* kinematically connected to the second auxiliary movable frame 18 and said movable support frame 23. More particularly, the end 26*b* of the intermediate lever 26 is pivotally mounted to the centre portion of one linking lever 27 having one end 27*a* hinged on the second movable frame 18 and a second end 27*b* hinged on one end 28*a* of a second linking lever 28, in turn having its second end 28*b* pivotally mounted to the movable support frame 23.

Figure 5:
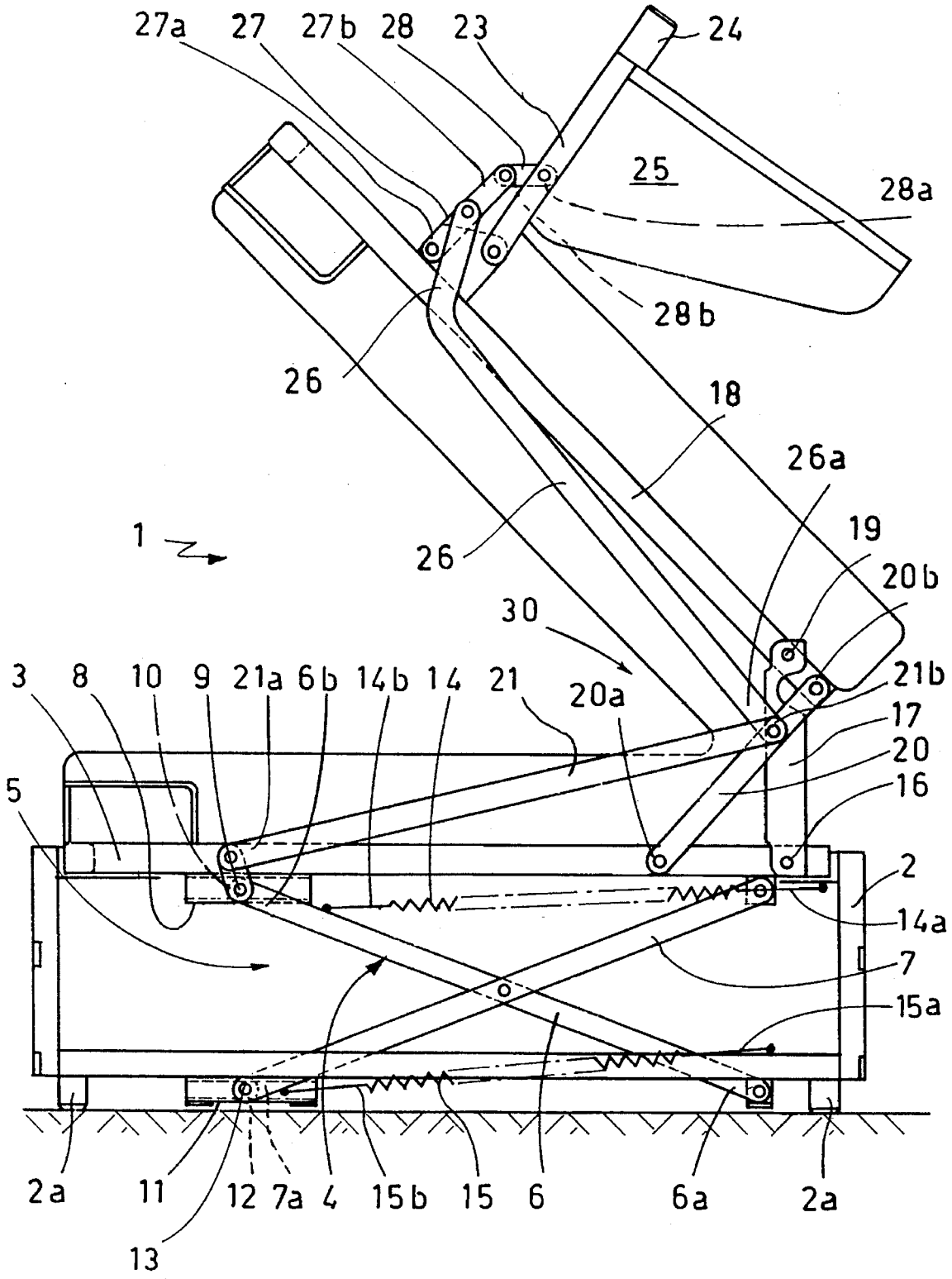
FIGS. 5 and 6 are side views of a second and third embodiment respectively of a sofa-bed, at an intermediate position between the open and closed positions.

Referring to the embodiment shown in FIG. 5, it will be noted that the sofa-bed 1 therein shown only has some small differences as regards the synchronization lever 21 and intermediate lever 26. In said second embodiment, in fact, the synchronization lever 21 has its second end 21*b* directly hinged on the interconnecting lever 20 that, in the same manner as in the embodiment shown in FIGS. 1, 2 and 3, connects the main movable frame 3 to the second auxiliary movable frame 18. In its turn, the intermediate lever 26 has one end 26*a* pivotally mounted to the interconnecting lever 20 and the sinchronization lever 21 at the mutual pivot point thereof. The second end 26*b* of the intermediate lever 26 is kinematically connected to the second auxiliary movable frame 18 and the movable support frame 23 in exactly the same manner as previously described.

Figure 6:
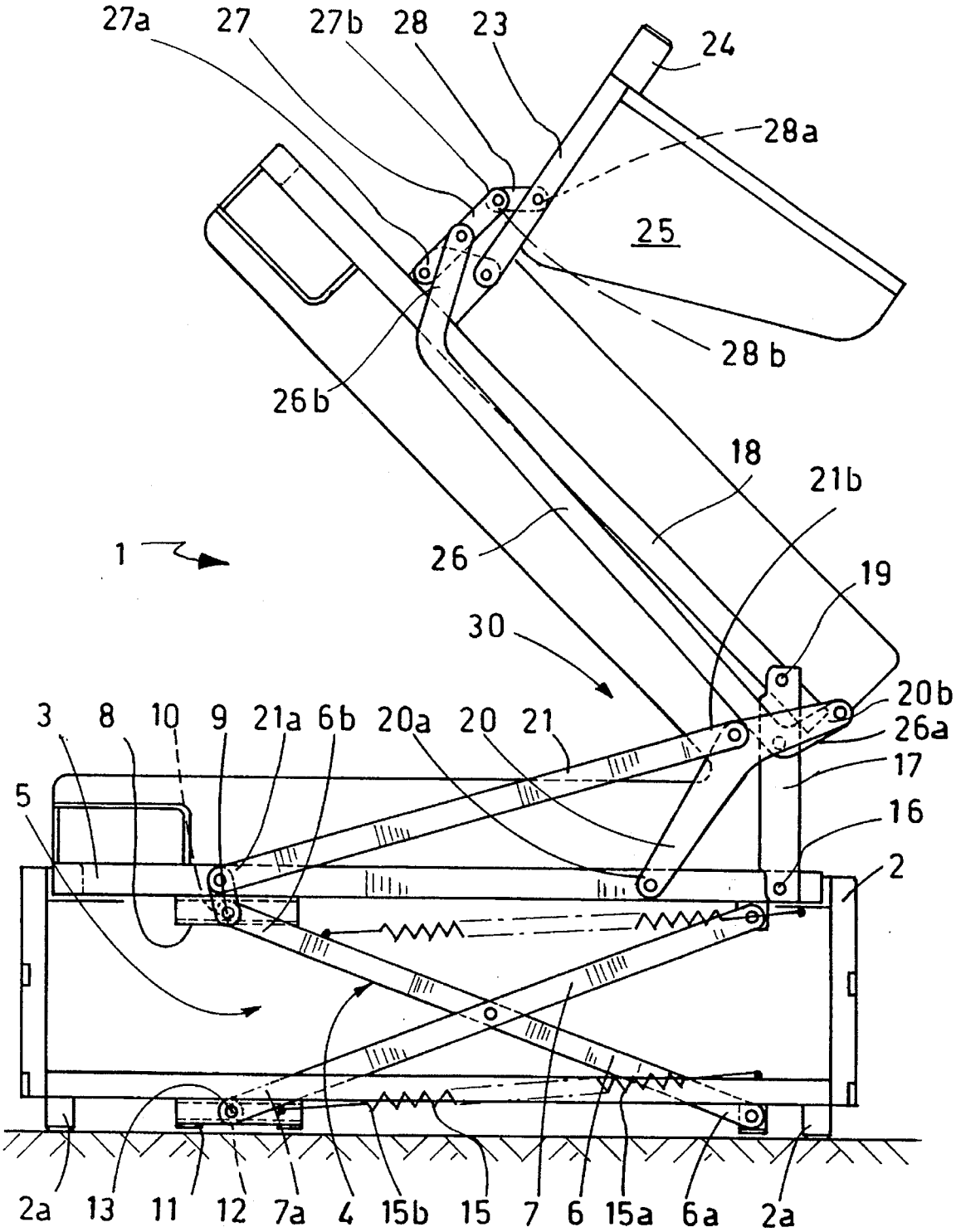

Referring finally to the embodiment shown in FIG. 6, it is pointed out that in this case the second end 21*b* of the synchronization lever 21 is hinged on the interconnecting lever 20. Said interconnecting lever, preferably having a curved conformation, exhibits one end 20*a* hinged on the main movable frame 3, in the same manner as previously described, and a second end 20*b* kinematically connected to the first auxiliary movable frame 17 by means of the intermediate lever 26. In fact the intermediate lever 26 is pivotally mounted to the first auxiliary movable frame 17 and has one end 26*a* hinged on the second end 20*b* of the interconnecting lever 20, the opposite end thereof 26*b* being kinematically connected to the second auxiliary movable frame 18 and the movable support frame 23, exactly in the same manner as in the embodiment shown in FIGS. 1, 2 and 3.

Operation of the sofa-bed having an articulated folding structure described above mainly as regards structure, is as follows.

If one wishes to pass from the closed position, in which the use of the sofa-bed as a sofa is provided, to the open position in which the use of the sofa-bed as a bed is provided, it is necessary to rotate the movable support frame 23 so as to cause the rotation of the intermediate lever 26 by means of the first and second linking levers 27 and 28. Since said intermediate lever 26 and connecting lever 20, kinematically engage the three movable frames 3, 17 and 18 with each other, following the rotation of the intermediate lever 26 a simultaneous rotation of the second and first auxiliary movable frames 18 and 17 is achieved, which auxiliary movable frames 18 and 17 will thus tend to take a position in alignment with the main movable frame 3. During this rotatory alignment movement, because of the synchronization lever 21 kinematically connecting the auxiliary movable frames 17 and 18 to the pantograph linkage 4, the simultaneous raising of the main movable frame 3 above the fixed carrying framework 2 is achieved.

It is important to underline that it is not possible to obtain the opening of the sofa-bed 1 by directly lifting the second auxiliary movable frame 18. In this case, in fact, by effect of the particular starting arrangement of the levers, the movable support frame 23 would tend to rotate in the opposite direction relative to the second auxiliary movable frame 18. However, as shown in FIG. 1, the frame 23 cannot carry out such a rotation. In other words, it is necessary that the movable support frame 23 should be first rotated relative to the second auxiliary movable frame beyond a given critical angle. Only at this point one can directly act on the second auxiliary movable frame 18 and open the sofa-bed 1. Practically, the movable frame 23, linking levers 27 and 28 and intermediate lever 26 advantageously embody a kinematic locking at the closed position, by virtue of which mattresses of high elastic stiffness which thereby offer better supporting capabilities can be used.

It is also to be pointed out that the helical springs 14 and 15 greatly facilitate raising of the main movable frame 3 and, as a result, opening of the sofa-bed 1. In addition, while passing from the closed position to the open position, the first auxiliary movable frame 17 rotates through about 90° and elastically loads the torsion bar 40 that advantageously during the closing step will give back the elastic energy previously stored.

Finally, during the sofa-bed opening, the movable support frame 23 advantageously reaches a position substantially perpendicular to the second auxiliary movable frame 18 bringing the auxiliary feet 24 into contact with the floor.

If on the contrary it is wished to pass from the open position to the closed position, the end of the second auxiliary movable frame 18 is acted upon so that said frame 18 is rotated in a counterclockwise direction with reference to the accompanying figures. During this rotation, thanks to the intermediate lever 26 the interconnecting lever 20 ad the synchronization lever 21, the simultaneous rotation of the first auxiliary movable frame and the descent of the main movable frame 3 is achieved.

During this closing step, the torsion bar 40 gives back the stored energy, whereas the first and second helical springs 14 and 15 are elastically re-loaded as a result of the closure of the pantograph linkage 4. Simultaneously with the above operation, the movable support frame 23 comes in alignment with the second auxiliary movable frame 18 bringing the sofa back 25 to the correct position for a sofa.

The invention achieves important advantages.

The sofa-bed 1, while exhibiting a very simple structure, can be brought from the closed position to the open position and vice versa by a single operation and is therefore of very practical use.

In addition, as already said, the sofa-bed 7 is very steady in its closed position.

Finally, it will be recognized that, since the main movable frame 3 is kinematically connected to the second auxiliary movable frame, no retaining device is necessary for mechanically locking the main movable frame above the fixed carrying framework. In fact, in the open position the frame weight prevents the bed from spontaneously going back to the closed position.

What is claimed is:

1. A sofa-bed having an articulated folding structure comprising:

a fixed carrying framework (2);

a main movable frame (3) connected to the fixed carrying framework (2) through a pantograph linkage (4), said main movable frame (3) and pantograph linkage (4) defining a lifting unit (5) for moving the main movable frame from a position in which it is housed in the bottom of the fixed carrying framework (2) to an operating raised position with respect to the fixed framework itself;

at least one first auxiliary movable frame (17) rotatably and consecutively engaged to the main movable frame (3) at one pivot axis (16);

at least one second auxiliary movable frame (18) rotatably and consecutively engaged to said first auxiliary movable frame (17) at a second pivot axis (19); and an interconnecting lever (20) operating between the main movable frame (3) of said lifting unit (5) and the second auxiliary movable frame (18), said first and second auxiliary movable frames (17, 18) and interconnecting lever (20) defining an overturning unit (30) for rotating the auxiliary movable frames (17 and 18) from a position in which they are folded over on the main movable frame (3) to a position in which they are consecutively aligned relative to each other and the main movable frame (3), wherein said sofa-bed further comprises a synchronization lever (21) which is engaged at one end (21*a*) thereof to the pantograph linkage (4) and at the other end to said overturning unit (30) for timing the lifting movement of said main movable frame (3) with the rotations carried out by said auxiliary movable frames (17, 18).

2. The sofa-bed as claimed in claim 1, wherein said second end (21*b*) of the synchronization lever (21) is hinged on the first auxiliary movable frame (17), said interconnecting lever (20) having one end (20*a*) hinged on the main movable frame (3) and a second end (20*b*) hinged on the second auxiliary movable frame (18).

3. The sofa-bed as claimed in claim 2, further comprises a movable support frame (23) hinged on the second auxiliary movable frame (18) and an intermediate lever (26) having one end (26) pivotally mounted to the first auxiliary movable frame (17) and the opposite end (26*b*) kinematically connected to said second auxiliary movable frame (18) and movable support frame (23).

4. The sofa-bed as claimed in claim 3, wherein the end (26*b*) of the intermediate lever (26) kinematically connected to the second auxiliary movable frame and the movable support frame, is pivotally mounted to the centre portion of one linking lever (27) one end (27*a*) of which is hinged on the second auxiliary movable frame and the opposite end (27*b*) of which is hinged on one end (28*a*) of a second linking lever (28) which in turn has its second end (28*b*) pivotally mounted to said movable support frame (23).

5. The sofa-bed as claimed in claim 1, wherein said second end (21*b*) of the synchronization lever (21) is hinged on the interconnecting lever (20), said interconnecting lever (20) having one end (20*a*) hinged on the main movable frame (3) and a second end (20*b*) hinged on the second auxiliary movable frame (18).

6. The sofa-bed as claimed in claim 5, further comprising a movable support frame (23) hinged on the second auxiliary movable frame (18) and an intermediate lever (26) having one end (26*a*) pivotally mounted to the interconnecting lever (20) and the synchronization lever (21) at their pivot point and the opposite end (26*b*) kinematically connected to said second auxiliary movable frame (18) and movable support frame (23).

7. The sofa-bed as claimed in claim 1, wherein said second end (21*b*) of the synchronization lever (21) is hinged on said interconnecting lever (20), said interconnecting lever (20) having one end (20*a*) hinged on the main movable frame (3) and a second end (20*b*) kinematically connected to the first auxiliary movable frame (17).

8. The sofa-bed as claimed in claim 7, further comprising a movable support frame (23) hinged on the second auxiliary movable frame (18), and an intermediate lever (26) pivotally mounted to the first auxiliary movable frame (17) and having one end (26*a*) hinged on the second end (20*b*) of said interconnecting lever (20) and the opposite end (26,*b*) kinematically connected to said second auxiliary movable frame (18) and movable support frame (23).

9. The sofa-bed as claimed in claim 1, wherein said pantograph linkage (4) comprises one lifting rod (6) having one end (6*a*) hinged on the fixed carrying framework (2) and a second end (6*b*) slidably and rotatably linked to one horizontal guide element (8) integral with said main movable frame (3), and a second lifting rod (7) centrally hinged on the first lifting rod (6) at a commun fulcrum and having one end (7*a*) slidably and rotatably linked to a second horizontal guide element (11) integral with the fixed carrying framework (2) and a second end (7*b*) hinged on the main movable frame (3).

10. The sofa-bed as claimed in claim 9, comprising one roller (10) rotatably linked to one pin (9) rigidly carried by the second end (6*b*) of said first lifting rod (6), said first roller (10) being slidably engaged in said first horizontal guide element (8), and a second roller (12) rotatably linked to a second pin (13), rigidly carried by the first end (7*a*) of said second lifting rod (7), said second roller (12) being slidably engaged in said second horizontal guide element (11).

11. The sofa-bed as claimed in claim 1, comprising a torsion bar (40) having one end (40*a*) fastened to said main movable frame (2) and a second end (40*b*) fastened to said first auxiliary movable frame (17).

* * * * *